United States Patent [19]

Buteux et al.

[11] Patent Number: 4,570,559

[45] Date of Patent: Feb. 18, 1986

[54] METHOD OF IMPLANTING HAIR ON A SHEET SUPPORT

[76] Inventors: Patrick Buteux, 107, rue du Gé76000 Rouen; Pierre Buteux, "Le Bois Tison" Saint-Jacques Sur Drnetal, 76160 Darnetal, both of France

[21] Appl. No.: 661,406

[22] Filed: Oct. 16, 1984

[30] Foreign Application Priority Data

Oct. 25, 1983 [FR] France ..... 83 16972

[51] Int. Cl.[4] ..... D05C 15/00

[52] U.S. Cl. ..... 112/266.2; 132/53

[58] Field of Search ..... 112/1, 79.5, 266.2, 112/439, 410; 132/56, 53

[56] References Cited

U.S. PATENT DOCUMENTS 2,253,635 8/1941 Mann ..... 132/56 X 2,667,879 2/1954 Mann et al. ..... 112/79.5

3,240,176 3/1966 Morrison ..... 112/439 X 3,513,860 5/1970 Kost ..... 132/56

*Primary Examiner*—Ronald Feldbaum

*Attorney, Agent, or Firm*—Lackenbach Siegel Marzullo Presta & Aronson

[57] ABSTRACT

A method of implanting hairs (2) on a sheet support (1), the method comprising the steps of: laying the hairs flat and parallel on the sheet in a dense lock; stitching the hairs to the sheet by means of a plurality of needles (4) each having a tip which passes through the sheet entraining a bight of a hair to form a hair loop under the sheet, the said needles being offset from one another in a direction perpendicular to the parallel hairs to prevent any two needles from entraining the same hair on the same stitching stroke; and fixing the said looped bights of hair under the sheet.

7 Claims, 3 Drawing Figures

METHOD OF IMPLANTING HAIR ON A SHEET SUPPORT

The present invention relates to implanting hair on a sheet support, in particular for making wigs, hair pieces, or dolls' heads.

BACKGROUND OF THE INVENTION

Previously known methods of implanting hair in wigs or hair pieces are often manual with the hair being fixed in a manner comparable to fixing lengths of wool in a carpet. For dolls, there exist machines which implant tufts of hair through large holes made in the scalp: this does not look natural.

Preferred implementations of the invention provide a very simple method of implanting which is capable of a high degree of automation and of high speed manufacture, and which is capable of producing natural-looking work.

SUMMARY OF THE INVENTION

The present invention provides a method of implanting hairs on a sheet support, the method comprising the steps of: laying the hairs flat and parallel on the sheet in a dense lock; stitching the hairs to the sheet by means of a plurality of needles each having a tip which passes through the sheet entraining a bight of a hair to form a hair loop under the sheet, the said needles being offset from one another in a direction perpendicular to the parallel hairs to prevent any two needles from entraining the same hair on the same stitching stroke; and fixing the said looped bights of hair under the sheet.

Advantageously, the said bights are fixed with glue.

The invention makes it possible to use sewing machines of conventional type to which a head having a plurality of needles is fitted, the spacing between the needles and the size of the step by which the surface of the sheet is advanced being chosen as a function of the desired implanting density. The head is thus moved back and forth perpendicularly to the surface to be stitched, while the surface moves past the head.

The hairs may be stitched substantially in the middle so that two strands of much the same length extend from each hole. It is also possible to stitch the hairs near to one of their ends: the shorter hair, although practically invisible in the finished work then serves to "thicken" the hair.

BRIEF DESCRIPTION OF THE DRAWINGS

An implementation of the invention is described by way of example with reference to the accompanying drawing, in which.

MORE DETAILED DESCRIPTION

Figure 1:
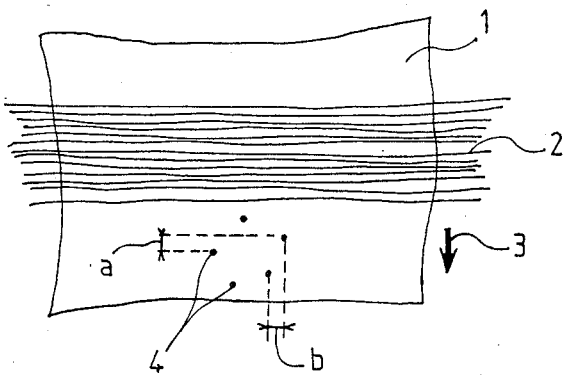
FIG. 1 is a plan view of hairs aligned on a sheet support prior to being inserted under a five-needle implanting head.
Figure 2:
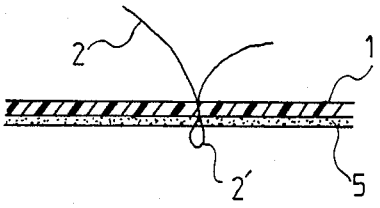
FIG. 2 is a diagrammatic section showing how one hair is implanted in the support sheet.

FIG. 1 shows a support sheet 1 drawn here in the form of a plane rectangle, although the sheet 1 may have any contour other than rectangular, and need not necessarily be plane: it may be warped, in particular when dolls' scalps are to be fitted with hair.

The sheet 1 may be made of any material which is flexible enough and strong enough to be punctured by needles without tearing. It is most often in the form of a sheet of plastic, for example of a rubber-like nature, and from one to a few millimeters thick. It may also be made of cloth.

On the sheet 1, there are disposed hairs 2 in the form of a dense lock in which the hairs are substantially parallel to one another. Only a few hairs can be shown in the figure, but it must be understood that there are very many of them and that they form a close-packed mat of small thickness on the surface of the support 1.

The support 1 and the hairs 2 are moved forward in the direction of an arrow 3 (i.e. perpendicularly to the hairs) in such a manner as to pass beneath an implanting head fitted with five needles 4. This implanting head can readily be mounted on an ordinary type of sewing machine instead of the usual needle. In variants, the number of needles may be other than five, and they may be mounted in a special machine instead of being fitted to a sewing machine.

The needles 4 are disposed in such a manner that there is no line parallel with the hairs which includes two needles nor is there any line perpendicular to the hairs which includes two needles. In other words, there is an offset a between the needles in the direction of the arrow 3 and an offset b in the perpendicular direction. The offset a ensures that any given hair is engaged by only one needle of the head when the head is driven into the support 1. The offset b ensures that implanting takes place simultaneously in five parallel lines spaced apart by the offset b, thereby defining the width of the work done.

Figure 3:
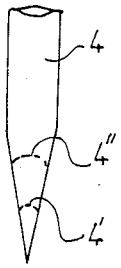
FIG. 3 shows possible profiles of the tip of a needle suitable for the invention.

The tips of the needles 4 are shaped as shown in FIG. 3 which is very greatly enlarged. Instead of being sharply pointed, they are rounded and concave in accordance with the profiles shown dotted at 4' and 4'' in order to facilitate entraining a hair on the needle down stroke. The profile 4' or 4'' or any other profile of the same type is chosen as a function of the difficulty of puncturing the material which constitutes the support 1.

On each down stroke of the implanting head, each needle entrains a hair into the support 1. The tip of each needle 4 projects a few millimeters (e.g. 2 or 3) beneath the sheet 1 and then rises leaving behind a loop 2' formed in the bight of the hair 2 which was driven through the sheet by the needle and which remains in place. The more resilient the material constituting the sheet 1, greater its tendency to close up the hole formed by the needle 4 where it passed through the sheet and the better the loop stays in place. In addition, the loop remains in place because of the hair's own resilience which causes the hair to form a rounded loop which is larger than the subsisting hole, even if it is a rather loose fit around the hair.

Once the hairs have thus been implanted along a row (of five lines in the present example) perpendicular to the hairs of the lock, the work is repeated using another lock on an adjacent row, and so on. Once the area to be implanted has been covered, the hairs which have not been implanted are removed by gentle hand pulling, or by any other suitable method.

In order to finally retain the implanted hairs in place, the underside of the sheet 1 is covered in glue, thereby fixing the hairs in a layer of glue 5.

As has been mentioned, the invention is readily implemented on a conventional type of sewing machine which has been adapted to receive the multi-needle implanting head. The system used for holding and moving the support may likewise be adapted as a function of its nature. If the support is warped, it is appropriate to consider a specialized lower holding system.

In particular, it may be advantageous to move the surface to be moved from above rather than from below, in which case the lower holding system may include a grid which is perforated by holes to allow the needles to pass, with the shape of the holes allowing the needles to advance as the support is moved.

Naturally the invention is applicable both to natural hair and to synthetic hair.

We claim:

1. A method of implanting hairs on a sheet support, the method comprising the steps of: laying the hairs flat and parallel on the sheet in a dense lock; stitching the hairs to the sheet by means of a plurality of needles each having a tip which passes through the sheet entraining a bight of a hair to form a hair loop under the sheet, the said needles being offset from one another in a direction perpendicular to the parallel hairs to prevent any two needles from entraining the same hair on the same stitching stroke; and fixing the said looped bights of hair under the same sheet.

2. A method according to claim 1, wherein the said looped bights are fixed by means of glue.

3. A method according to claim 1 or 2, including an additional step of removing hairs which have not been stitched through the support sheet.

4. A method according to claim 1, wherein the said plurality of needles are fixed to a common stitching head.

5. A method according to claim 4, wherein the head is moved back and forth perpendicularly to the surface to be stitched, while the surface is moved past the head.

6. A method according to claim 1, wherein the sheet is made of plastic.

7. A method according to claim 1, wherein the sheet constitutes the scalp of a doll.

* * * * *